United States Patent [19]

York et al.

[11] Patent Number: 4,835,828

[45] Date of Patent: Jun. 6, 1989

[54] AUTOMATIC TUBE EXPANDER FOR A HEAT EXCHANGER

[75] Inventors: John D. York, Clarksville; Edward M. Peppard, Woodlawn, both of Tenn.; Bruce A. Haugen, Owatonna, Minn.

[73] Assignee: American Standard Inc., New York, N.Y.

[21] Appl. No.: 247,987

[22] Filed: Sep. 22, 1988

[51] Int. Cl.[4] ..... B23P 15/26

[52] U.S. Cl. ..... 29/157.3 C; 29/727; 29/157.3 R

[58] Field of Search ..... 29/157.3 C, 157.4, 157.3 AH, 29/727, 157.3 R

[56] References Cited

U.S. PATENT DOCUMENTS

| | | | |
|---|---|---|---|
| 3,688,533 | 9/1972 | Ames | 29/727 |
| 4,584,751 | 4/1986 | Gray et al. | 29/157.3 |
| 4,584,765 | 4/1986 | Gray | 29/727 |
| 4,586,250 | 5/1986 | Cooper, Jr. et al. | 29/727 |
| 4,597,171 | 7/1986 | Kitayama et al. | 29/157.3 C |
| 4,720,902 | 1/1988 | Gray | 29/157.3 |
| 4,745,678 | 5/1988 | Gray | 29/727 |

OTHER PUBLICATIONS

Burr Oak Advertisement, (no date).

*Primary Examiner*—P. W. Echols
*Assistant Examiner*—Kevin Jordan
*Attorney, Agent, or Firm*—William J. Beres; David L. Polsley; Robert J. Harter

[57] ABSTRACT

An automated heat exchanger tube expander includes an automatically adjustable tool stop, an automatically adjustable back support, and a universal base support. The adjustable stop, the back support, and the base support function together to facilitate the manufacturing of various size tube and fin heat exchangers. The automatic tube expander avoids the time consuming set up for each different size heat exchanger normally required by manual tube expanders.

16 Claims, 3 Drawing Sheets

AUTOMATIC TUBE EXPANDER FOR A HEAT EXCHANGER

DESCRIPTION

1. Technical Field

The invention generally pertains to tube expanders and more specifically to heat exchanger tube expanders and a method of expanding the tubes of a heat exchanger.

2. Background of the Invention

Heat exchangers having tubes traversed by perforated heat transfer fins are often manufactured by radially expanding the tubes to provide an interference fit with the fins. Machines that carry out this operation are often referred to as tube expanders.

Current tube expanders, such as those build by the Burr Oak Tool and Gauge Company of Sturgis, MI, include a gang of hydraulically driven tube expanding rods that expand several tubes at one time. Expanders such as these may also include flaring sleeves, under the same hydraulic drive as the rods, for flaring the ends of the tubes. A pneumatic cylinder may provide a stop which prevents a rod guide from prematurely crushing a heat exchanger until the rods have extended substantially the full length through the tubes. After the rods are fully extended, the pneumatic stop is released to allow the rod guide to drop to another mechanical stop. As the rod guide drops, the flaring sleeves flare the ends of the tubes, completing the tube expanding operation.

Present tube expanders, such as the one just described, require a great deal of setup time when changing from one size heat exchanger to another. For example, if after completing the expanding operation of a relatively large heat exchanger, several manual adjustments are required before a smaller heat exchanger having shorter tubes arranged in a different pattern can be acted upon by the expander. A back support needs to be lowered to the height of the smaller heat exchanger. The above-mentioned pneumatic stop and the other mechanical stop both need to be lowered. A sleeve pusher must be adjusted to provide a proper flaring operation. And the heat exchanger's base support needs to be changed to accept the new tube distribution pattern.

Additional background information is disclosed in U.S. Pat. No. 4,745,678 which is specifically incorporated by reference herein.

SUMMARY OF THE INVENTION

Since the setup time for present tube expanders is very time consuming, it is an object of the invention to provide an apparatus that both expands and flares heat exchanger tubes, and automatically adjusts itself to accept various size heat exchangers.

An advantage of the invention is that there is no need to take various measurements on the apparatus every time a different size heat exchanger is inserted in the apparatus.

Another object of the invention is to provide a universal base support that accepts heat exchangers having different tube distribution patterns without having to adjust, modify, or reposition the base support.

A feature of the invention is a motor driven adjustable stop whose position automatically adjusts to vary the limit of travel of a flaring tool.

Another feature of the invention is a motor driven back support whose height automatically adjusts to meet the height of various heat exchangers.

An object of the invention is to couple the back support to the adjustable stop so that the adjustment of both can be provided by the same drive motor.

A feature of the invention is an adjustable back support with substantially uninterrupted back support from the top to the bottom of a heat exchanger inserted in the tube expanding apparatus.

Another object of the invention is to minimize the number of stops by automatically driving the adjustable stop between two different positions so that the adjustable stop can serve the same function previously accomplished by two individual stop devices.

Another feature of the invention is that the adjustable stop is coupled to a lead screw that enables the adjustable stop to provide positive support as the stop travels from one position to the other.

Another feature of the invention is a motor driven flaring sleeve pusher adjustment that automatically adjusts the relative movement between tube expanding rods and flaring sleeves.

Yet another object of the invention is to coordinate the repositioning of all of the above mentioned adjustments with the use of a single control.

These and other objects, features, and advantages are accomplished by a novel tube expanding apparatus. The apparatus includes several tube expanding rods and flaring sleeves adapted to expand the tubes of various size heat exchangers. A motor coupled to a lead screw repositions an adjustable stop that limits the travel of the flaring sleeves. The adjustable stop is driven between two different predetermined stop positions as the apparatus acts on a heat exchanger. These predetermined positions are automatically changed to accommodate various size heat exchangers.

DESCRIPTION OF THE PREFERRED EMBODIMENT

Figure 1:
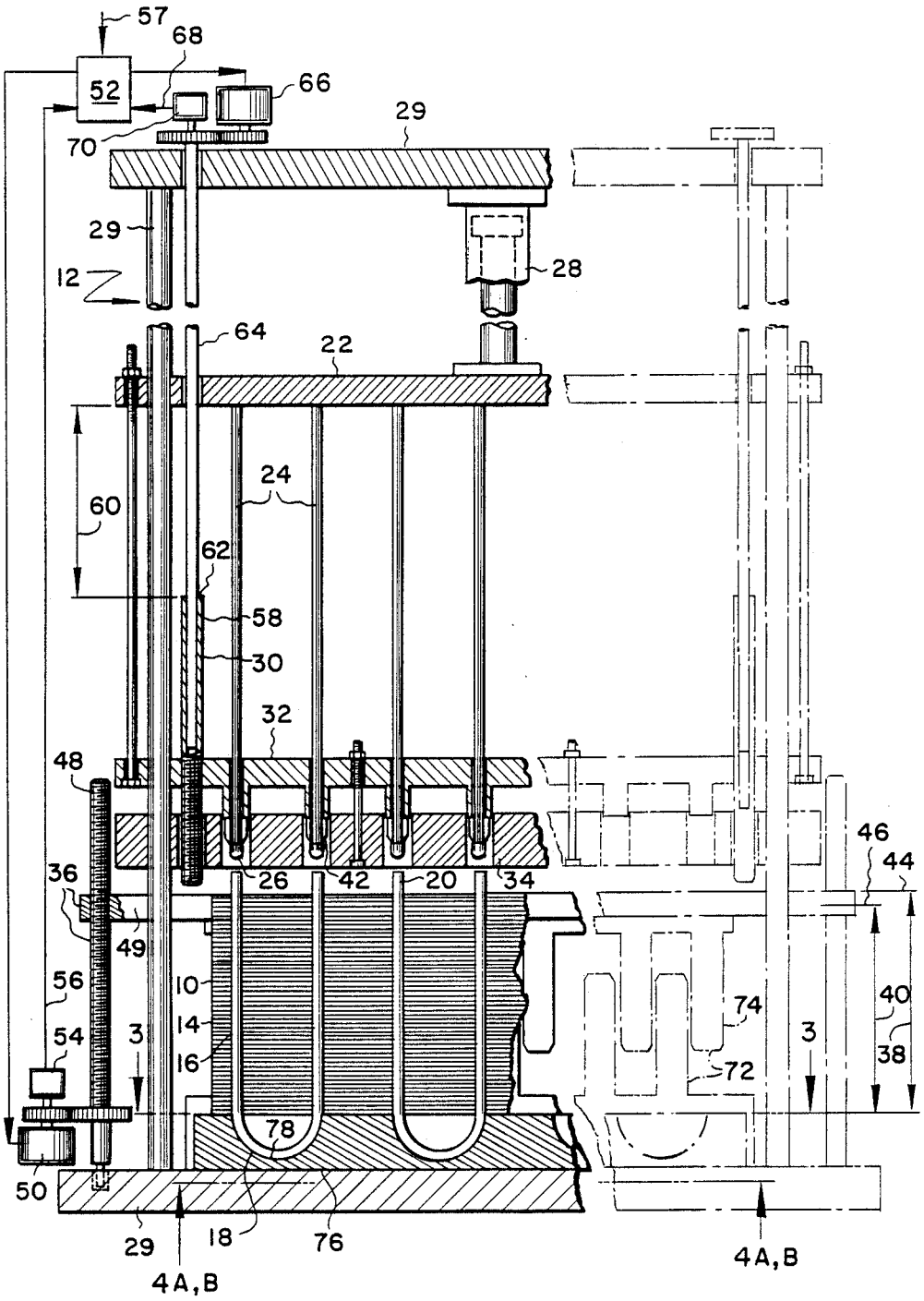
FIG. 1 schematically illustrates a tube expander before expanding and flaring the tubes of a heat exchanger.

FIG. 1 schematically illustrates a heat exchanger 10 in position to be acted upon by a tube expander 12 incorporating the subject invention. Heat exchanger 10 includes several plate type heat transfer fins 14 that are traversed by several heat exchanger tubes 16. Tubes 16 are connected at one end by U-bends 18. Tube expander 12 is used to radially expand tubes 16 so that they tightly engage fins 14. Expander 12 also flares an open end 20 of tube 16 so they may be later connected to other tube fittings (not shown).

The tube expanding operation begins with a rod pusher 22 forcing a plurality of tube expanding rods 24 through tubes 16. A leading edge 26 of rods 24 has an outside diameter that is greater than an unexpanded tube's 16 inside diameter, so that tubes 16 expand radially as rods 24 travel through the length of tubes 16. Rod pusher 22 is driven by a hydraulic cylinder 28 attached to a frame 29. Hydraulic cylinder 28 represents any means for providing the force required to drive rods 24 through tubes 16.

Figure 2:
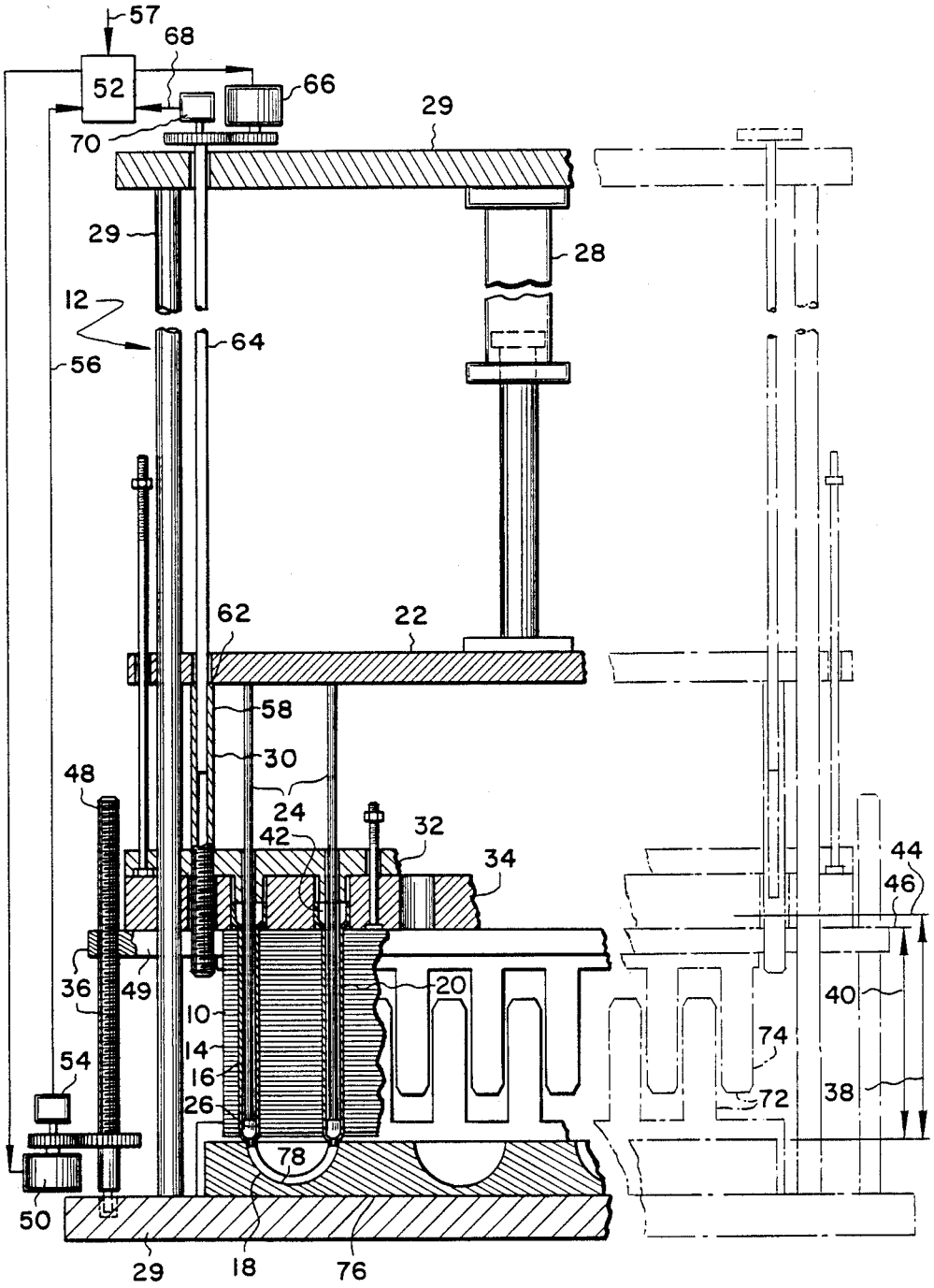
FIG. 2 schematically illustrates a tube expander after expanding and flaring the tubes of a heat exchanger.

Toward the end of the tube expanding process, rod pusher 22 impacts a sleeve pusher adjustment 30. Rod pusher 22 continues to travel after impact, forcing a flaring sleeve pusher 32 and a rod guide 34 to travel along with it. The three members 22, 32, and 34 continue moving until the three lock up against an adjustable stop 36, as shown in FIG. 2.

As tubes 16 expand radially, they shrink in length causing the final length 40 of heat exchanger 10 to be less than its initial lenght 38. To ensure that the final length 40 of heat exchanger 10 is uniform and of a predetermined length, rod guide 34, within the limits of adjustable stop 36, exerts a final compressive force against heat exchanger 10. The compressive force is provided by the combined weights of rod guide 34 and flaring sleeve pusher 32 and is further augmented by the driving force of rod pusher 22 conveyed through sleeve pusher adjustment 30 and flaring sleeve pusher 32.

Ends 20 of tubes 16 are radially expanded further by flaring sleeves 42 which are slideably disposed on tube expanding rods 24 and have an outside diameter that is greater than rod ends 26. Flaring sleeves 42 are driven into tube ends 20 by flaring sleeve pusher 32 under the driving force of rod pusher 22 acting on sleeve pusher adjustment 30.

To prevent the weight of rod guide 34 from prematurely crushing heat exchanger 10 at a rate faster than that which heat exchanger 10 shrinks naturally during the tube expanding process, adjustable stop 36 moves from a first predetermined position 44 to a second predetermined position 46 as rods 24 travel through tubes 16. The difference between the first and second position is generally greater than or equal to the heat exchanger's change in length (length 38 minus length 40) as its tubes are expanded.

Adjustable stop 36 is repositioned by a lead screw 48 threaded into a cross member 49 and driven by a motor 50 under the command of a control 52, such as an Allen-Bradley PLC-2 programmable controller. Any position feedback device (first position feedback device), such as an encoder 54, provides control 52 with a first feedback signal 56 indicating the position of adjustable stop 36. In response to a user input 57 representing the various lengths of the heat exchangers 10 to be expanded, control 52 automatically adjusts stop 36 to accommodate the various lengths. Input 57 represents any means for providing control 52 with information indicating the size or length of heat exchanger 10. Examples of input 57 include a selector switch or preprogrammed data stored in control 52.

Similar to adjustable stop 36, sleeve pusher adjustment 30 also includes a lead screw 58. Lead screw 58 is threaded into flaring sleeve pusher 32. A clearance 60 provides a separable connection between rod pusher 22 and the top 62 of lead screw 58 and determines the approximate length through which rods 24 travel before flaring sleeves 42 are driven through tube ends 20. Clearance 60 is a variable spaced apart distance that is adjustable by turning a shaft 64. Shaft 64 is keyed to turn lead screw 58 but allow relative axial movement between shaft 64 and lead screw 58. Shaft 64 is turned by a motor 66 under the command of control 52. Control 52 receives a second feedback signal 68 from a second position feedback device, such as an encoder 70, which indicates the position of lead screw 58. In response to user input 57, representing the various lengths of the heat exchangers 10 to be expanded, control 52 automatically adjusts lead screw 58 to accommodate the various lengths.

As a refinement to one embodiment of the invention, an adjustable back support 72 is added to help support heat exchanger 10 being acted upon by tube expander 12. Back support 72 includes an adjustable portion 74 that can be directly connected to adjustable stop 36 so that repositioning of adjustable stop 36 automatically varies the length of the back support 74 to meet the needs of heat exchanger 10.

Figure 4A:
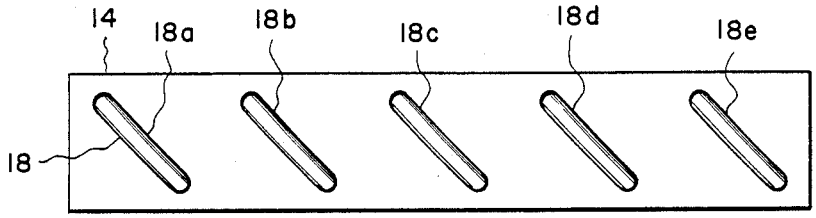
FIG. 4*a* and 4*b* are bottom views of different heat exchangers having different U-bend patterns.
Figure 4B:
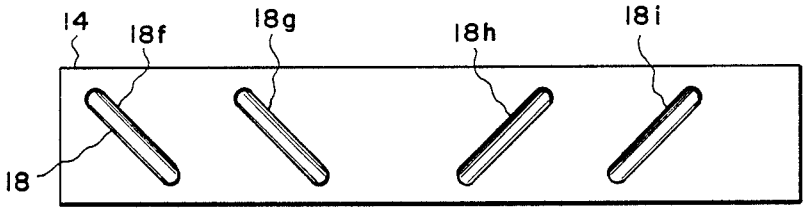
Figure 3:
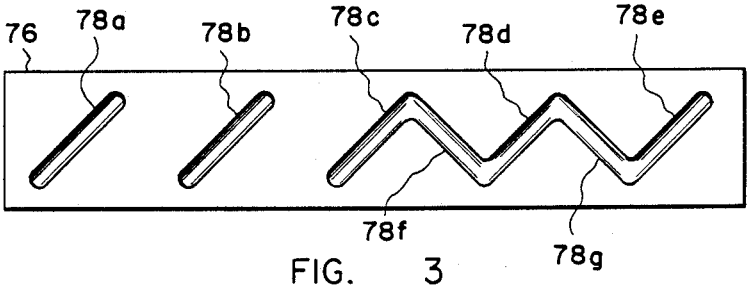
FIG. 3 is a top view of a universal base support.

A further refinement to one embodiment of the invention is a universal base support 76 which is fastened in fixed relationship with frame 29 and supports heat exchanger 10 in general alignment with rods 24. Universal base support 76 has several pockets 78 arranged in a unique pattern to accept different heat exchangers 10 having different U-bend patterns. FIGS. 4*a* and 4*b* illustrate two different U-bend patterns, both of which would fit in universal base support 76 shown in FIG. 3. More specifically, U-bends 18*a*, 18*b*, 18*c*, 18*d* and 18*e* would fit in U-bend pockets 78*a*, 78*b*, 78*c*, 78*d*, 78*e* respectively, and U-bends 18*f*, 18*g*, 18*h*, and 18*i* would fit in pockets 78*a*, 78*b*, 78*f*, and 78*g* respectively.

Although the invention is described with respect to a preferred embodiment, modifications thereto will be apparent to those skilled in the art. Therefore, the scope of the invention is to be determined by reference to the claims which follow.

We claim:

1. An apparatus for expanding heat exchanger tubes of various length heat exchangers, comprising:

a frame;

a plurality of tube expanding rods;

a rod pusher slideably connected to said frame and said tube expanding rods, said rod pusher providing a driving force to push said rods through said heat exchanger tubes, thereby radially expanding said tubes into an interference fit against a plurality of heat transfer fins traversing said tubes;

a plurality of flaring sleeves slidably disposed around said plurality of rods and being adapted to further radially expand an end portion of said heat exchanger tubes beyond the extend to which said rods expand said heat exchanger tubes;

a flaring sleeve pusher slidably disposed around said plurality of rods and adjacent to said plurality of flaring sleeves, said sleeve pusher being adapted to push said plurality of sleeves into said end portion of said plurality of heat exchanger tubes under said driving force of said rod pusher;

an adjustable stop positioned to mechanically limit the travel of said plurality of rods and said plurality of flaring sleeves with respect to said frame;

a stop drive coupled to said adjustable stop for automatically repositioning said adjustable stop; and a control for controlling said stop drive in response to an input representing various lengths of said heat exchangers to be acted upon by said apparatus.

2. The apparatus as recited in claim 1, further comprising an adjustable back support lying in a plane generally parallel to said tube expanding rods and adapted to help hold any of said heat exchangers in parallel alignment with said rods, said back support including an adjustable portion having a variable position with respect to said frame, said adjustable portion being power driven in response to said control so that said adjustable portion is automatically repositioned according to the various lengths of said heat exchangers to be acted upon by said apparatus.

3. The apparatus as recited in claim 2, wherein said adjustable portion of said back support is mechanically coupled to said adjustable stop so that said adjustable stop and said adjustable portion of said back support are both automatically repositioned by said stop drive.

4. The apparatus as recited in claim 1, wherein said stop is associated with a first position feedback device that indicates the position of said adjustable stop.

5. The apparatus as recited in claim 1, wherein said adjustable stop and said stop drive are coupled together by way of a lead screw.

6. The apparatus as recited in claim 1, wherein said various length heat exchangers include different patterns of U-bends interconnecting said heat exchanger tubes, and further comprising a universal base support having a plurality of pockets for receiving said different patterns of U-bends.

7. The apparatus as recited in claim 1, further comprising a rod guide slidably connected to said frame and slidably disposed around said rods, said rod guide being interposed between said flaring sleeve pusher and said adjustable stop so that said flaring sleeve pusher is prevented from extending further into said tubes when said rod guide abuts both said flaring sleeve pusher and said adjustable stop.

8. The apparatus as recited in claim 7, wherein said stop drive moves said stop from a first predetermined position to a second predetermined position as said rods travel through the length of said heat exchanger tubes, so that said rod guide is prevented from dropping to said second predetermined position before said rods have travelled an appreciable distance through said heat exchanger tubes, thereby preventing the weight of said rod guide from prematurely crushing any of said heat exchangers before the length of said heat exchanger tubes have been reduced as a result of the radial expansion produced by said rods.

9. The apparatus as recited in claim 1, wherein said rod pusher is hydraulically driven.

10. The apparatus as recited in claim 1, further comprising a sleeve pusher adjustment providing a separable connection between said rod pusher and said flaring sleeve pusher for delivering said driving force of said rod pusher to said flaring sleeve pusher when said connection is made, and for allowing rod movement independent of flaring sleeve pusher movement when said connection is separated, whereby a substantial length of said tubes can be expanded by said rods before said flaring sleeves further expand said end portion of said tubes, said separable connection of said sleeve pusher adjustment providing a variable spaced apart distance between said rod pusher and said flaring sleeve pusher to accommodate said various length heat exchangers, said sleeve pusher adjustment being adjusted by a motor controlled by said control in reponse to said input representing various lengths of said heat exchangers and in response to a second position feedback device indicating the position of said sleeve pusher adjustment.

11. An apparatus for expanding heat exchanger tubes of various length heat exchangers having different patterns of u-bends interconnecting said heat exchanger tubes, comprising:

a frame;

a plurality of tube expanding rods;

a universal base support fastened in fixed relationship with said frame and having a plurality of pockets for receiving said different patterns of U-bends, said base support being generally adapted to individually support any of said heat exchangers in general alignment with said tube expanding rods;

a hydraulically driven rod pusher connected to said frame and said tube expanding rod, said rod pusher providing a driving force to push said rods through said heat exchanger tubes, thereby radially expanding said tubes into an interference fit against a plurality of heat transfer fins traversing said tubes, said rod pusher being further adapted to withdraw said plurality of rods from within said tubes to enable removal of any of said heat exchangers from said apparatus;

a plurality of flaring sleeves slideably disposed around said plurality of rods and being adapted to further radially expand an end portion of said heat exchanger tubes beyond the extent to which said rods expand said heat exchanger tubes;

a flaring sleeve pusher slideably disposed around said plurality of rods and adjacent to said plurality of flaring sleeves, said sleeve pusher being adapted to push said plurality of sleeves into said end portion of said plurality of heat exchanger tubes under said driving force of said rod pusher;

an adjustable stop position to mechanically limit the travel of said plurality of rods and said plurality of flaring sleeves with respect to said frame;

a stop drive coupled by way of a lead screw to said adjustable stop for automatically repositioning said stop from a first predetermined position to a second predetermined position as said rods travel through the length of said heat exchanger tubes, so that said rod guide is prevented from dropping to said second predetermined position before said rods have travelled an appreciable distance through said heat exchanger tubes, thereby preventing the weight of said rod guide from prematurely crushing any of said heat exchangers before the length of said heat exchanger tubes have been reduced as a result of the radial expansion produced by said rods;

a first position feedback device associated with said adjustable stop for providing a first position feedback signal indicating the position thereof;

a control for controlling said stop drive in response to said first position feedback signal and in response to an input representing the various lengths of said heat exchangers to be acted upon by said apparatus;

a rod guide slideably connected to said frame and slideably disposed around said rods, said rod guide being interposed between said flaring sleeve pusher and said adjustable stop so that said flaring sleeve pusher is prevented from extending further into said tubes when said rod guide abuts both said flaring sleeve pusher and said adjustable stop; and a sleeve pusher adjustment providing a separable connection between said rod pusher and said flaring sleeve pusher for delivering said driving force of said rod pusher to said flaring sleeve pusher when said connection is made and for allowing rod movement independent of flaring sleeve pusher movement when said connection is separated, whereby a substantial length of said tubes can be expanded by said rods before said flaring sleeves further expand said end portion of said tubes, said separable connection of said sleeve pusher adjustment providing a variable spaced apart distance between said rod pusher and said flaring sleeve pusher to accommodate said various length heat exchangers, said sleeve pusher adjustment being adjusted by a motor controlled by said control in response to said input representing various lengths of said heat exchangers and in response to a second position feedback device indicating the position of said sleeve pusher adjustment.

12. The apparatus as recited in claim 11, further comprising an adjustable back support line in a plane generally parallel to said tube expanding rods and adapted to hold any of said heat exchangers in parallel alignment with said rods, said back support including an adjustable portion having a variable position with respect to said frame, said adjustable portion being power driven in response to said control so that said adjustable portion is automatically repositioned according to the various lengths of said heat exchangers to be acted upon by said apparatus.

13. The apparatus as recited in claim 12, wherein said adjustable portion of said back support is mechanically coupled to said adjustable stop so that said adjustable stop and said adjustable portion of said back support are both automatically repositioned by said stop drive.

14. A method of simultaneously expanding a plurality of heat exchanger tubes traversing a plurality of fins comprising the steps of:

controlling a hydraulic cylinder to force a plurality of tube expanding rods and a plurality of flaring sleeves through said plurality of heat exchanger tubes;

using a motor driven lead screw to limit the travel of a rod guide slideably disposed around said tube expanding rods: and repositioning said lead screw as said tube expanding rods are being forced through said plurality of heat exchanger tubes.

15. The method as recited in claim 14, further comprising the steps of generating a first feedback signal indicating the position of said lead screw.

16. The method as recited in claim 14, further comprising the step of repositioning an adjustable back support simultaneously with the repositioning of said lead screw.

* * * * *